US008313163B2

(12) United States Patent
Eun et al.

(10) Patent No.: US 8,313,163 B2
(45) Date of Patent: Nov. 20, 2012

(54) METHOD AND SYSTEM TO COMPENSATE FOR PROCESS DIRECTION MISALIGNMENT OF PRINTHEADS IN A CONTINUOUS WEB INKJET PRINTER

(75) Inventors: Yongsoon Eun, Webster, NY (US); R. Enrique Viturro, Rochester, NY (US); Jess R. Gentner, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 333 days.

(21) Appl. No.: 12/773,398

(22) Filed: May 4, 2010

(65) Prior Publication Data

US 2011/0273502 A1 Nov. 10, 2011

(51) Int. Cl.
*B41J 29/38* (2006.01)

(52) U.S. Cl. ..... 347/14; 347/9; 347/5

(58) Field of Classification Search ..... 347/5, 9, 347/12, 14, 19

See application file for complete search history.

(56) References Cited

U.S. PATENT DOCUMENTS 5,541,629 A 7/1996 Saunders et al.
6,312,079 B1 11/2001 Anderson et al.
6,315,388 B1 11/2001 Goh
6,361,153 B1 3/2002 Wafler
6,402,279 B1 6/2002 Torgerson et al.
6,648,438 B1 * 11/2003 Tandou et al. ..... 347/9
6,659,581 B2 12/2003 Schloeman et al.
7,029,084 B2 4/2006 Schloeman et al.
7,104,624 B2 9/2006 Schloeman et al.
7,384,115 B2 6/2008 Barkley
7,441,851 B2 10/2008 Liou et al.
2002/0041299 A1 * 4/2002 Lee et al. ..... 347/19
2008/0100655 A1 * 5/2008 Furuya et al. ..... 347/14

* cited by examiner

*Primary Examiner* — Lam S Nguyen
(74) *Attorney, Agent, or Firm* — Maginot, Moore & Beck, LLP

(57) ABSTRACT

A method of operating a printer enables printheads mounted on print bars to be operated to compensate for misalignment of printheads in the process direction. The method includes identifying a position in the process direction for each printhead in a plurality of printheads, selecting one of the identified printhead positions as a reference printhead position, identifying a printhead timing parameter for each printhead mounted to at least one print bar, generating a firing signal for the printheads mounted to the at least one print bar, and adjusting delivery of the firing signal by the identified printhead timing parameter for each corresponding printhead mounted to the at least one print bar to coordinate actuation of inkjet ejectors in the printheads mounted to the at least one print bar and compensate for misalignment of the printheads in the process direction.

15 Claims, 8 Drawing Sheets

METHOD AND SYSTEM TO COMPENSATE FOR PROCESS DIRECTION MISALIGNMENT OF PRINTHEADS IN A CONTINUOUS WEB INKJET PRINTER

TECHNICAL FIELD

This disclosure relates generally to printhead alignment in an inkjet printer having one or more printheads, and, more particularly, to printhead alignment in the process direction in a continuous web inkjet printer.

BACKGROUND

Ink jet printers have printheads that operate a plurality of inkjets that eject liquid ink onto an image receiving member. The ink may be stored in reservoirs located within cartridges installed in the printer. Such ink may be aqueous, oil, solvent-based, or UV curable ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer. In some printing systems, an image of a printed image is generated by printing the printed image onto media or by transferring the printed image onto media, ejecting the media from the system, and then scanning the image with a flatbed scanner or other known offline imaging device. This method of generating a picture of the printed image suffers from the inability to analyze the printed image in situ and from the inaccuracies imposed by the external scanner. In some printers, a scanner is integrated into the printer and positioned at a location in the printer that enables an image of an ink image to be generated while the image is on media within the printer or while the ink image is on the rotating image member. These integrated scanners typically include one or more illumination sources and a plurality of optical detectors that receive radiation from the illumination source that has been reflected from the image receiving surface. The radiation from the illumination source is usually visible light, but the radiation may be at or beyond either end of the visible light spectrum. If light is reflected by a white imaging surface, the reflected light has a similar spectrum as the illuminating light. In some systems, ink on the imaging surface may absorb a portion of the incident light, which causes the reflected light to have a different spectrum. In addition, some inks may emit radiation in a different wavelength than the illuminating radiation, such as when an ink fluoresces in response to a stimulating radiation. Each optical sensor generates an electrical signal that corresponds to the intensity of the reflected light received by the detector. The electrical signals from the optical detectors may be converted to digital signals by analog/digital converters and provided as digital image data to an image processor.

The environment in which the image data are generated is not pristine. Several sources of noise exist in this scenario and should be addressed in the registration process. For one, alignment of the printheads can deviate from an expected position significantly, especially when different types of imaging surfaces are used or when printheads are replaced. Additionally, not all inkjets in a printhead remain operational without maintenance. Thus, a need exists to continue to register the heads before maintenance can recover the missing jets. Also, some inkjets are intermittent, meaning the inkjet may fire sometimes and not at others. Inkjets also may not eject ink perpendicularly with respect to the face of the printhead. These off-angle ink drops land at locations other than were they are expected to land. Some printheads are oriented at an angle with respect to the width of the image receiving member. This angle is sometimes known as printhead roll in the art. The image receiving member also contributes noise. Specifically, structure in the image receiving surface and/or colored contaminants in the image receiving surface may be identified as ink drops in the image data and lightly colored inks and weakly performing inkjets provide ink drops that contrast less starkly with the image receiving member than darkly colored inks or ink drops formed with an appropriate ink drop mass. Thus, improvements in printed images and the analysis of the image data corresponding to the printer images are useful for identifying printhead orientation deviations and printhead characteristics that affect the ejection of ink from a printhead. Moreover, image data analysis that enables correction of printhead issues or compensation for printhead issues is beneficial.

One factor affecting the registration of images printed by different groups of printheads is printhead alignment. In some printers, multiple printheads are configured to enable the printheads to print a continuous line or bar on media in a cross-process direction. Aligning the printheads so the nozzles at one end of a printhead, such as the right end of the printhead, are spaced from nozzles at the other end of another printhead, such as the left end of the printhead, by a distance that is approximately the same as adjacent nozzles within a printhead. Alignment is also important for printheads that are arranged in a column to enable a second printhead in the column in the process direction to eject ink drops onto or next to ink drops ejected by a first printhead in the column. Consequently, detecting misalignment of printheads and measuring the distance required to compensate for the misalignment is important for image quality.

As printing systems increase in size so do the number of printheads used to print images on the media traveling through a print zone. Each of these printheads must receive a firing signal in order for the inkjet ejectors in a printhead to be actuated and ink ejected. Generating and distributing a firing signal for each printhead increases the hardware, interconnect, and processing loads on the printhead controller in the system. Addressing these increased loads without requiring a concomitant increase in the processing resources would be useful.

SUMMARY

A method of operating a printer enables a controller to generate less firing signals than the number of printheads in the printer while compensating for misaligned printheads in the process direction through the printer. The method includes identifying a position in the process direction for each printhead in a plurality of printheads mounted on at least one print bar, selecting one of the identified printhead positions as a reference printhead position for the printheads mounted to the at least one print bar, identifying a printhead timing parameter for each printhead mounted to the at least one print bar, the printhead timing parameter being identified with reference to the reference printhead, generating a firing signal for the printheads mounted to the at least one print bar, and adjusting delivery of the firing signal by the identified printhead timing parameter for each corresponding printhead mounted to the at least one print bar to coordinate actuation of inkjet ejectors in the printheads mounted to the at least one print bar and compensate for misalignment of the printheads in the process direction.

A printer is configured to use the method to generated firing signals for printheads in the printer to compensate misalignment of printheads in the process direction through the printer. The printer includes a media transport that is configured to transport media through the printer in a process direction, a plurality of print bars, each print bar having a plurality of printheads mounted to a print bar and a printhead driver circuit that is operatively connected to each printhead mounted to a print bar to deliver a timing signal to each printhead mounted to the print bar to eject ink onto media being transported past the plurality of printheads on the print bar by the media transport in the process direction, an imaging device mounted proximate to a portion of the media transport to generate image data corresponding to a cross-process portion of the media being transported through the printer in the process direction after the media has received ink ejected from the printheads mounted to the print bars, and a controller operatively connected to the imaging device and to the printhead driver circuits for the plurality of print bars, the controller being configured to identify a position in the process direction for each printhead in the plurality of printheads mounted on the print bars and a printhead timing parameter corresponding to the identified position for each printhead mounted to the print bars, to send the identified printhead timing parameter for each printhead mounted to the print bars to the printhead driver circuit for each print bar, and to generate a firing signal for at least one printhead driver circuit for at least one print bar, each printhead driver circuit receiving the firing signal being configured to adjust delivery of the firing signal by the identified printhead timing parameter received from the controller for each corresponding printhead to coordinate actuation of inkjet ejectors in the printheads mounted to the at least one print bar and compensate for misalignment of the printheads in the process direction.

BRIEF DESCRIPTION OF THE DRAWINGS

The foregoing aspects and other features of a printhead controller that compensates for process direction registration errors are explained in the following description, taken in connection with the accompanying drawings.

DETAILED DESCRIPTION

Figure 6:
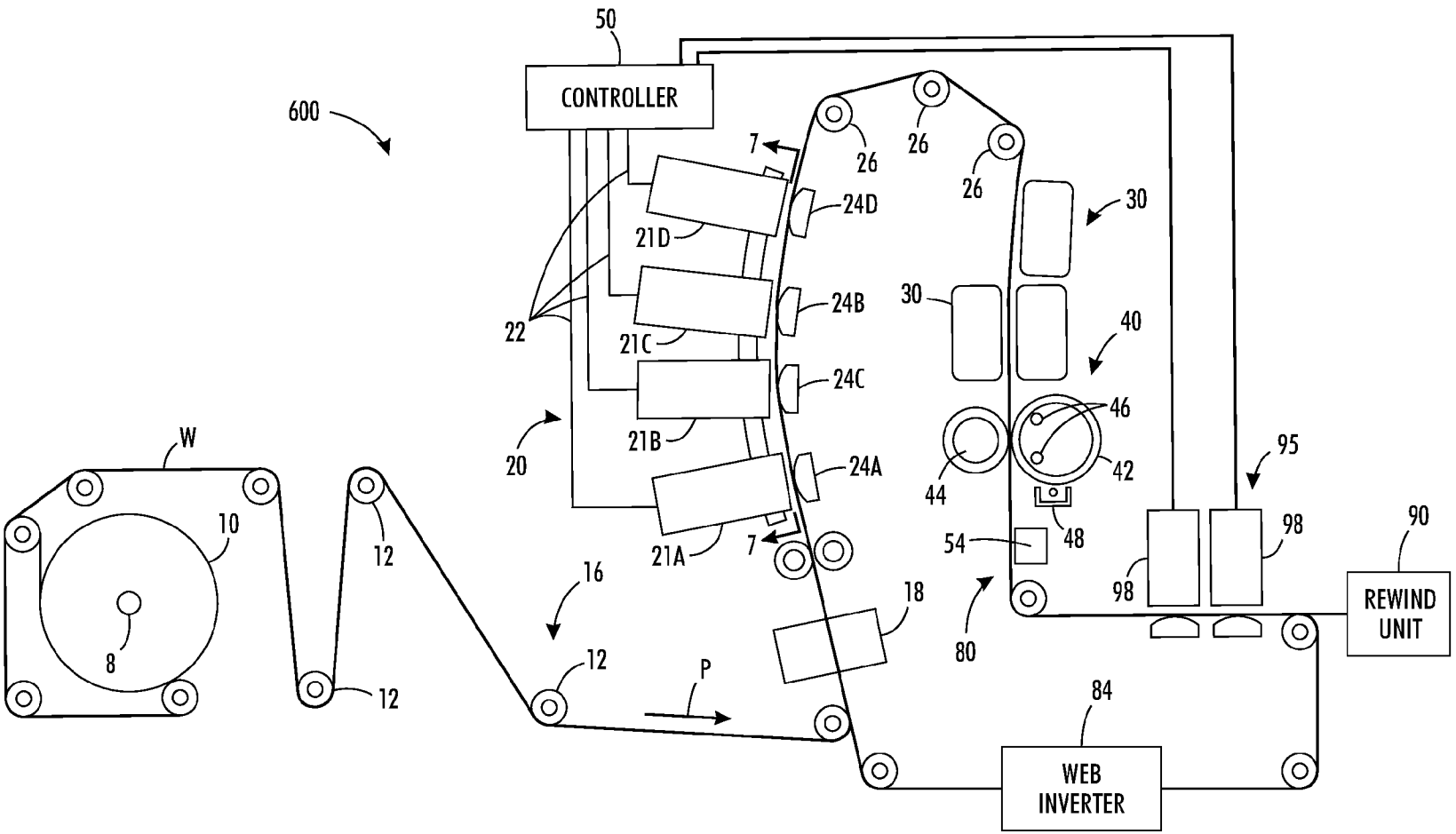
FIG. 6 is a schematic view of an improved inkjet imaging system that ejects ink onto a continuous web of media as the media moves past the printheads in the system.

Referring to FIG. 6, an inkjet imaging system 600 is shown that has been configured to enable electrical motors used to align printheads to be calibrated with reference to the sensitivity and backlash of the motors. For the purposes of this disclosure, the imaging apparatus is in the form of an inkjet printer that employs one or more inkjet printheads and an associated solid ink supply. However, the motor calibration methods described herein are applicable to any of a variety of other imaging apparatuses that use electromechanical motors or other actuators to align the positions of printheads in the system.

The imaging system includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 600 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color unit effectively extends across the width of the media and is able to eject ink directly (i.e., without use of an intermediate or offset member) onto the moving media. The arrangement of printheads in the print zone of system 600 is discussed in more detail with reference to FIG. 8. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to image data processed by the controller 50. The image data may be transmitted to the printer, generated by a scanner (not shown) that is a component of the printer, or otherwise generated and delivered to the printer. In various possible embodiments, a color unit for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like. As described in more detail below, the controller 50 generates a firing signal for each print bar unit or a group of print bar units positioned proximate one another. The firing signal is then delivered with reference to delay values stored in the print bar unit or the group of print bar units to compensate for misalignment of the printheads in the process direction.

Each of color units 21A-21D includes at least one electrical motor configured to adjust the printheads in each of the color units in the cross-process direction across the media web. In a typical embodiment, each motor is an electromechanical device such as a stepper motor or the like. One embodiment illustrating a configuration of print bars, printheads, and actuators is discussed below with reference to FIG. 4. In a practical embodiment, a print bar actuator is connected to a print bar containing two or more printheads. The print bar actuator is configured to reposition the print bar by sliding the print bar in the cross-process direction across the media web. Printhead actuators may also be connected to individual printheads within each of color units 21A-21D (FIG. 6). These printhead actuators are configured to reposition an individual printhead by sliding the printhead in the cross-process direction across the media web.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 6, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 500 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the print bar and printhead motors of color modules 21A-21D in order to adjust the positions of the printhead bars and printheads in the cross-process direction across the media web. The controller 50 may be configured with programmed instructions to implement one or both of the registration processes identified below.

The imaging system 600 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 4:
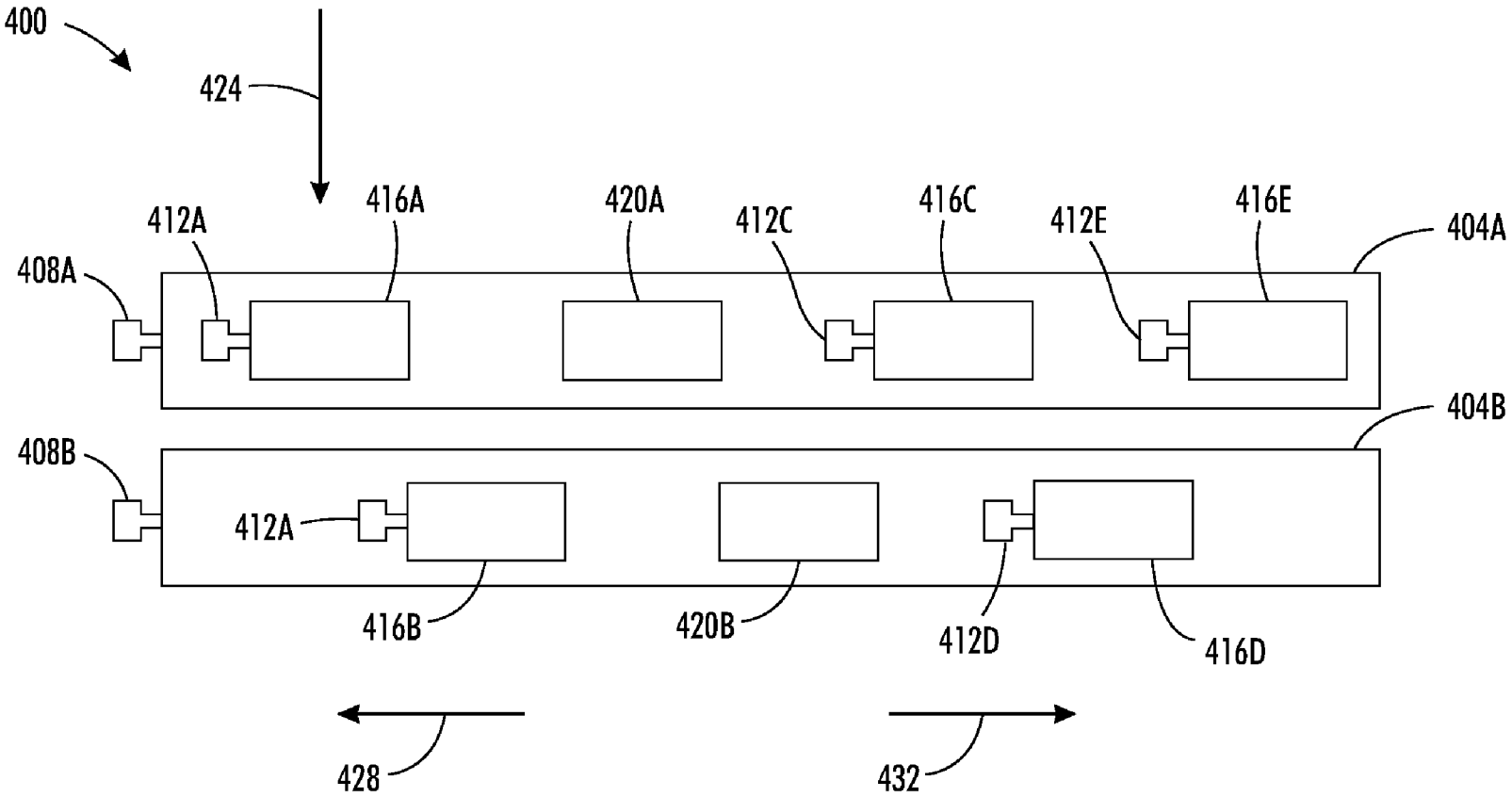
FIG. 4 is a schematic view of a print bar unit that may be used to configure an arrangement of printheads in a print zone of the imaging system of FIG. 6.
Figure 8:
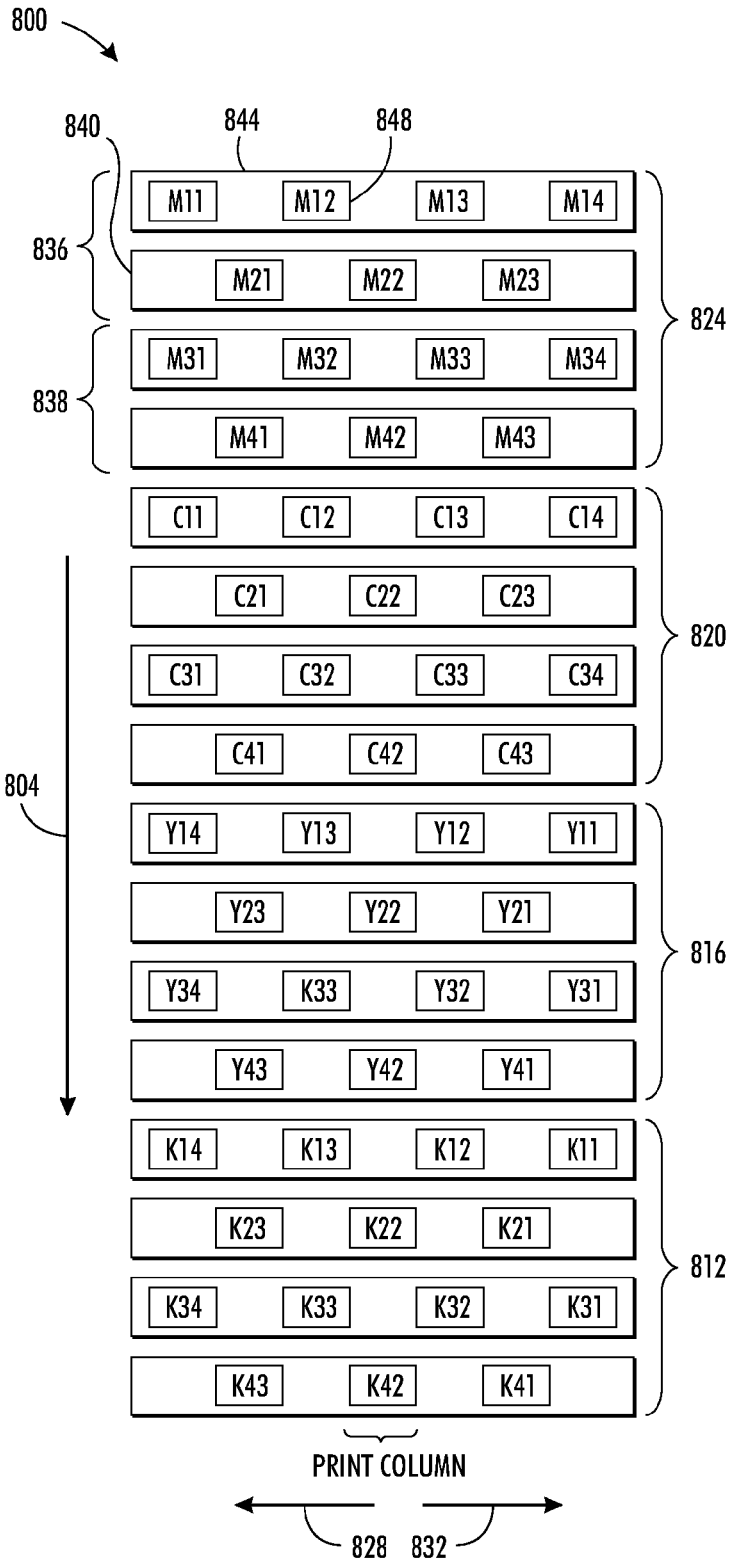
FIG. 8 PRIOR ART
FIG. 8 is a schematic view of a prior art printhead configuration viewed along lines 7-7 in FIG. 6.

A schematic view of a prior art print zone 800 that may be used in the system 600 is depicted in FIG. 8. The print bars and printheads of this print zone may be moved for alignment purposes using the processes described below when the print bars and printheads are configured with actuators for movement of the print bars and printheads as shown in FIG. 4. The print zone 800 includes four color modules or units 812, 816, 820, and 824 arranged along a process direction 804. Each color unit ejects ink of a color that is different than the other color units. In one embodiment, color unit 812 ejects black ink, color unit 816 ejects yellow ink, color unit 820 ejects cyan ink, and color unit 824 ejects magenta ink. Process direction 804 is the direction that an image receiving member moves as travels under the color unit from color unit 824 to color unit 812. Each color unit includes two print arrays, which include two print bars each that carry multiple printheads. For example, the print bar array 836 of magenta color unit 824 includes two print bars 840 and 844. Each print bar carries a plurality of printheads, as exemplified by printhead 848. Print bar 840 has three printheads, while print bar 844 has four printheads, but alternative print bars may employ a greater or lesser number of printheads. The printheads on the print bars within a print bar array, such as the printheads on the print bars 840 and 844, are staggered to provide printing across the image receiving member in the cross process direction at a first resolution. The printheads on the print bars of the print bar array 836 within color unit 824 are interlaced with reference to the printheads in the print bar array 838 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

FIG. 4 depicts a configuration for a pair of print bars that may be used in a color module of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counter-clockwise direction. The rotating shafts turn drive screws that translate print bars 404A-404B and printheads 416A-416E along the cross-process directions 428 and 432. As described herein, the measured sensitivity and backlash of motors 408A-408B and 412A-412E is the degree to which the rotation of the motors causes translation of the print bars and printheads along a cross-process direction across the media.

While the print bar units of FIG. 4 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar unit, an actuator may be operatively connected to the print bar or to the printhead. A process similar to the one discussed below may then be used to position such a wide printhead with respect to multiple printheads mounted to a single print bar or to other equally wide printheads mounted to other print bars. The actuators in this embodiment enable the inkjet ejectors of one printhead to be interlaced or aligned with the inkjet ejectors of another printhead in the process direction.

A test pattern may be printed onto media at the initialization of printing system operation, start of a job run, or during a job run by printing a portion of the test pattern in an inter-document zone on the media. Image data of the test pattern on the media is generated by the imaging system described above and processed by an image processing program implemented by one or more processors in the printing system. The analysis of the image data enables the positions of the printheads to be identified as well as any cross-process dimensional changes in the media as the media moves through the print zone. This positional information may then be used to operate actuators as described above with reference to FIG. 4 to correct the positions of the printheads. An appropriate registration test pattern and method of coarse printhead registration is disclosed in U.S. Utility application Ser. No. 12/754,730 hereby entitled "Test Pattern Effective For Coarse Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety. An appropriate registration test pattern and method of fine printhead registration is disclosed in U.S. Utility application Ser. No. 12/754,735 hereby entitled "Test Pattern Effective For Fine Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety.

Figure 1:
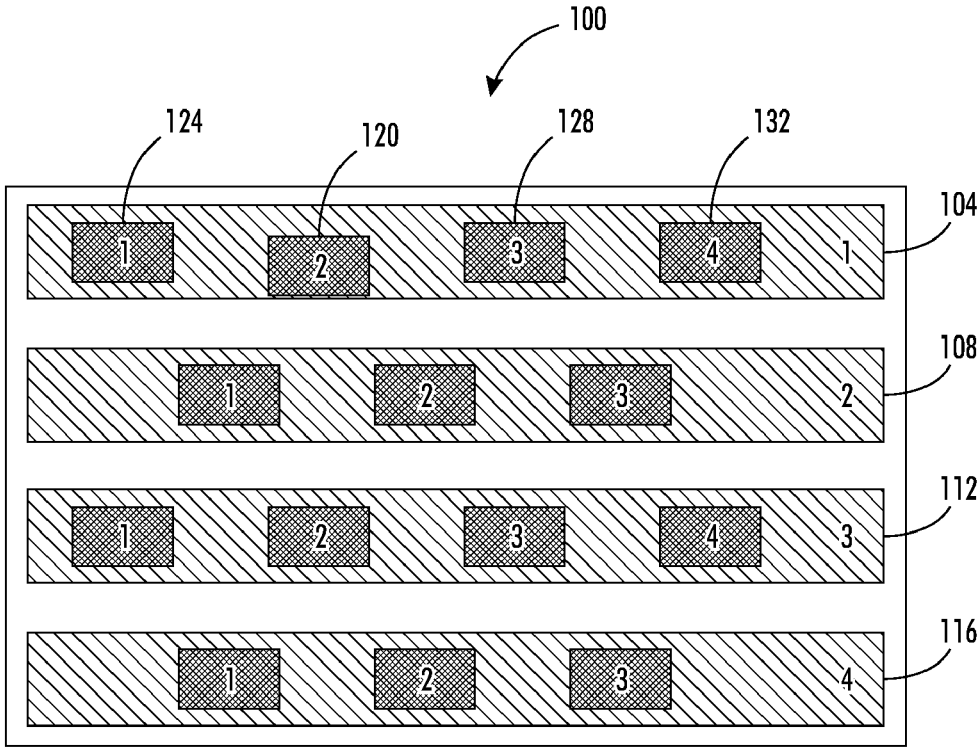
FIG. 1 is an example of printhead misalignment that produces printing registration errors in the process direction.

As noted above, the actuators move the printheads in a cross-process direction. Consequently, the actuators do not address alignment errors in the process direction. An example of printheads that are not perfectly aligned in the process direction is shown in FIG. 1. Each of the print bars 104, 108, 112, and 116 of a color unit 100 has three or four printheads mounted to it. For print bar 104, the printhead 120 is positioned slightly below the printheads 124, 128, and 132. This misalignment causes registration errors in the process direction. If all four printheads are actuated by firing signals at the same time, the resulting pattern exhibits the printhead misregistration. The firing signal for each printhead could be generated independently and delivered to the corresponding printhead at a time that compensates for the misalignment. This independent generation of each firing signal, however, presents quite a processing and distribution load for the fifty-six printheads that form the print zone depicted in FIG. 8. The process described more fully below enables a timing parameter to be identified for all of the printheads on a print bar or a group of print bars positioned proximate one another except for one printheads either on the print bar or in the group of print bars. This timing parameter is identified with reference to the one printhead for which no timing parameter value is generated. These timing parameters are stored in the printhead driver circuit for each print bar. A single firing signal is delivered to each printhead driver circuit and the timing parameters are used to deliver the firing signals to each printhead on the print bar independently. Thus, compensation for the process direction misalignment is provided and the processing load for the printhead controller and the distribution resources required to deliver the timing signal are reduced. Additionally, a timing parameter for each print bar may be identified and used to deliver the firing signal to each printhead driver circuit to compensate for errors in the positioning of the print bars in the print zone. As used in this document, "timing parameter" refers to an amount of time that is used to adjust delivery of a firing signal to a printhead driver circuit or to a printhead to compensate for a registration error in the process direction.

Figure 5:
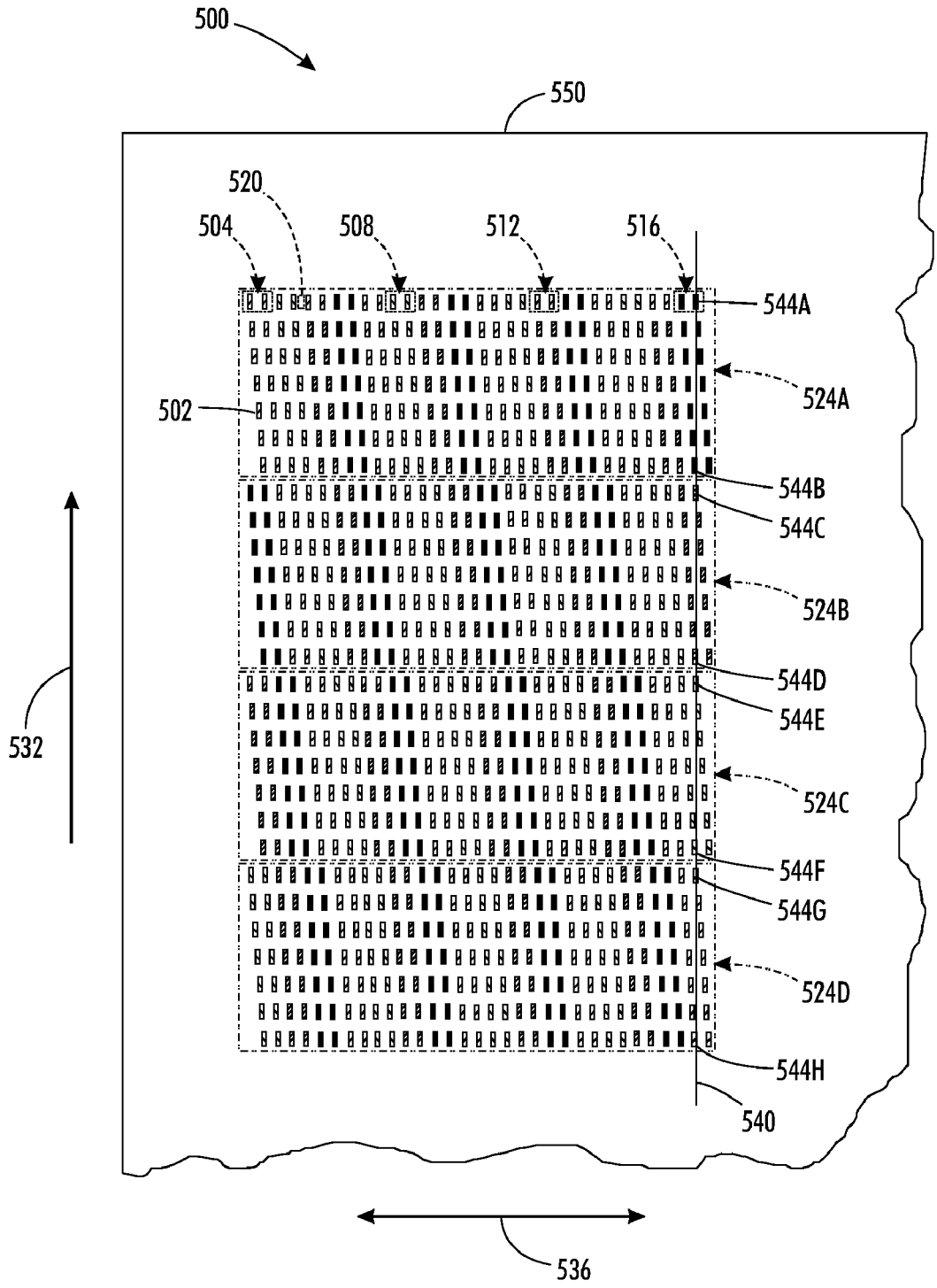
FIG. 5 is an illustration of a test pattern that may be used to detect alignment errors in a process direction as the web passes through a print zone.

An example of a registration test pattern suitable for use with the fine registration image processing method identified above is shown in FIG. 5. A fine registration pattern as the position data obtained with such a process is likely to be useful for positioning printheads in a printing system at a start of a print job or during a print job. The example test pattern 500 includes a series of dashes 502 generated on a media web 550 moving in process direction 532. The dashes 502 are generated with a predetermined distance between each dash. Each of the dashes is generated by a single ejector in a single printhead. Multiple copies of test pattern 500 may be generated along the cross-process direction of media web 550 from each of the printheads in each of the print bar units in the printer. Test pattern 500 may also be repeated along the process direction forming columns of repeating dashes in order to reduce the effects of random errors. As used in this document, a "dash" refers to a predetermined number of ink drops ejected by an inkjet ejector onto an image receiving substrate. A group of dashes printed by different ejectors form a test pattern. Image data corresponding to this test pattern may then be generated and analyzed to identify positions of the inkjet ejectors and printheads.

At steady state for a printing system, such as the one shown in FIG. 6, the average web velocity times the web material mass per length must be equal at all rollers or other non-slip web interface surfaces. Otherwise, the web would either break or go slack. To account for the differences in instantaneous velocities at rollers in or near a print zone, a double reflex processor interpolates between linear web velocities at a pair of rollers, one roller on each side of a marking station with reference to the direction of the moving web, to identify a linear velocity for the web at a position proximate the marking station. This interpolation uses the linear web velocity derived from the angular velocity of a roller placed at a position before the web reaches the marking station and the linear web velocity derived from the angular velocity of a roller placed at a position after the web passes by the marking station along with the relative distances between the marking station and the two rollers. The interpolated value correlates to a linear web velocity at the marking station. A linear web velocity is interpolated for each marking station. The interpolated web velocity at each marking station enables the processor to generate the firing signals for the printheads in each marking station to eject ink as the appropriate portion of the web travels past each marking station. A double reflex control system is described in U.S. Pat. No. 7,665,817, which is entitled "Double Reflex Printing" and which issued on Feb. 23, 2010 and is owned by the assignee of the present application. The disclosure of this patent is expressly incorporated herein by reference in its entirety.

Figure 2:
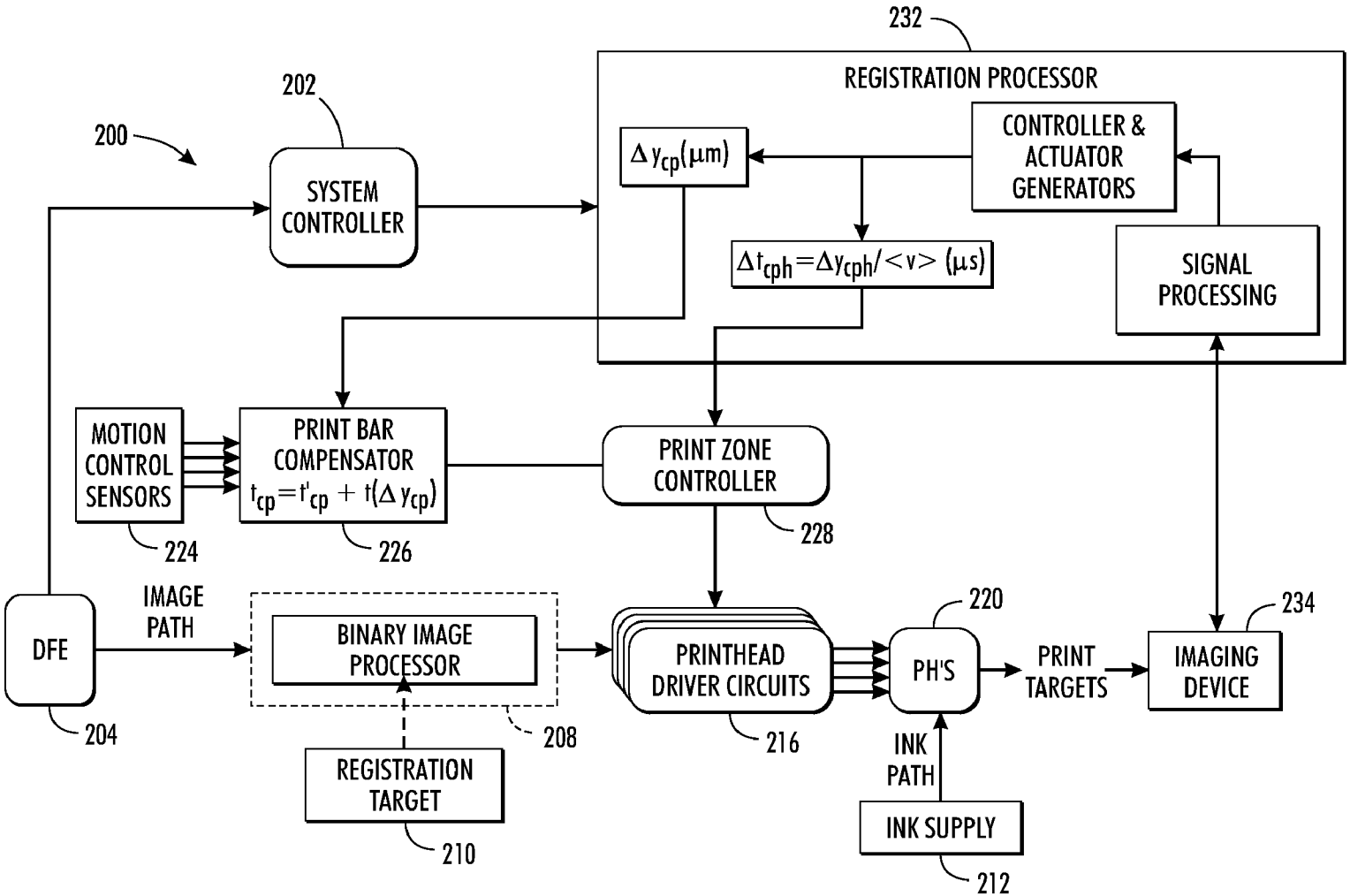
FIG. 2 is a block diagram of a web printing system that identifies dimensional changes in a web and changes the operation of components in the web printing system to compensate for dimensional changes that exceed predetermined thresholds.

To address misregistration that may arise from process direction misalignment of printheads in a web printing system, a method and system have been developed that measure the process direction misalignment of printheads mounted on a print bar and generate delay values that are used to deliver firing signals to printheads mounted to the print bar. The system 200 is shown in block diagram form in FIG. 2. As depicted in that figure, the web printing system 200 includes a system controller 202, a digital front end (DFE) 204, a binary image processor 208, the printhead driver circuits 216, a plurality of printheads 220, motion control sensors 224, a print bar position compensator 226, a print zone controller 228, a registration processor 232, and an optical imaging device 234.

In more detail, the system controller 202 receives control information for operating the web printing system from a digital front end (DFE) 204. During a job, image data to be printed are also provided by the DFE to the web printing system components that operate the printheads to eject ink onto the web and form ink images that correspond to the images provided by the DFE. These components include the binary image processor 208, and the printhead driver circuits 216. The binary processor 208 performs binary imaging processes, such as process direction norming. Each printhead driver circuit 216 delivers firing signals to the printheads mounted to one of the print bars to operate the inkjet ejectors in the printheads 220. Registration and color control are provided by the registration controller 232 to adjust the timing of inkjet firing. The imaging device 234 provides the registration controller 232 with image data of the web at a predetermined position along the web path through the web printing system. The registration controller performs signal processing on the image data received from the imaging device to identify printhead positions, print bar positions, and printhead timing parameters required for controlling the printheads. The printhead timing parameters are provided to the print zone controller 228, which sends them to the printhead driver circuits 216 to control delivery of firing signals to the printheads. The print bar position compensator 226 uses data from web motion sensors, such as rotary encoders, tension sensors, and the like, to identify a linear web speed for the media moving through the system. This information is combined with data obtained from the registration processor regarding the difference between the position of each print bar and the expected position for each print bar to generate a print bar timing parameter. The print zone controller 228 uses the print bar timing parameter to control delivery of a firing signal to a printhead driver circuit associated with the print bar for which the print bar timing parameter was generated. In this manner, process direction positioning errors of the print bars is addressed. As used in this document, "identify" and "calculate" include the operation of a circuit comprised of hardware, software, or a combination of hardware and software that reaches a result based on one or more measurements of physical relationships with accuracy or precision suitable for a practical application.

The controllers used in the system 200 include memory storage for data and programmed instructions. The controllers may be implemented with general or specialized programmable processors that execute programmed instructions. The instructions and data required to perform the programmed functions may be stored in memory associated with each controller. The programmed instructions, memories, and interface circuitry configure the controller to perform the functions described above. These controllers may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

Figure 3:
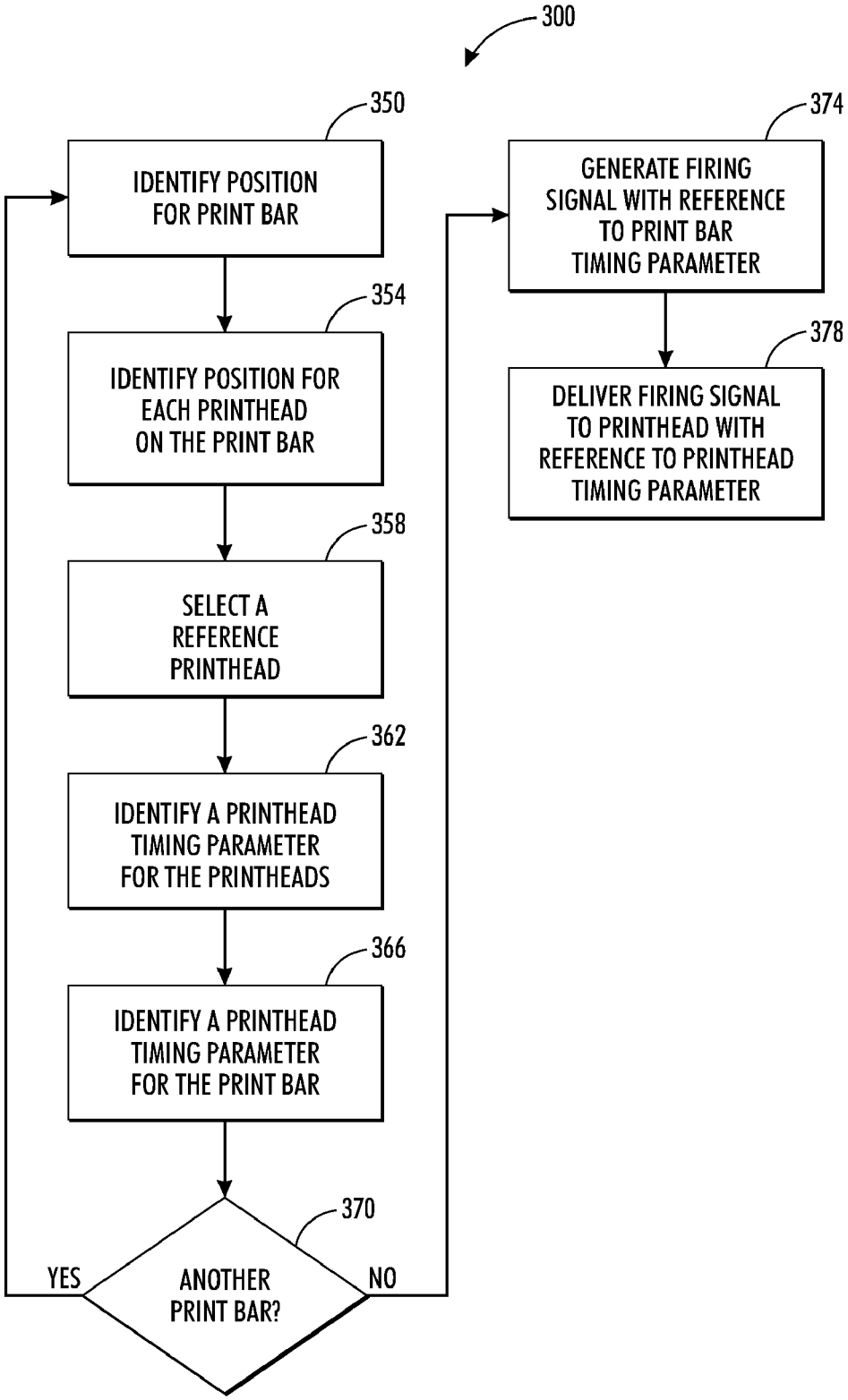
FIG. 3 is a process for identifying timing parameters for printheads to compensate for printhead misalignment in the process direction.

A process that compensates process direction misalignment between printheads mounted to a print bar is depicted in FIG. 3. Process 300 uses image data of a registration test pattern printed on media, such as the fine registration test pattern of FIG. 5, to identify print bar and printhead positions. In one embodiment, the imaging system captures data from an imaging area that is approximately twenty inches wide in the cross process direction. The printheads print at a resolution of 600 dpi in the cross process direction and over 12,000 optical detectors are arrayed in a single row along the bar to generate a single scanline across the imaging member. The optical detectors are configured in association in one or more light sources that direct light towards the surface of the media web. Once image data corresponding to the test pattern are captured, the absolute position of each print bar and each printhead mounted to a print bar in the process direction is determined (block 350, 354). Using the imaging device described above, the position of each printhead corresponds to the optical detectors that detect the test pattern dashes generated by inkjet ejectors in each printhead. The absolute detected position of each detected printhead may be determined by finding an average position of the optical sensors detecting test pattern dashes generated by each printhead. The process direction position for a print bar may be determined as an average process direction position for the printheads mounted to the print bar.

Figure 7:
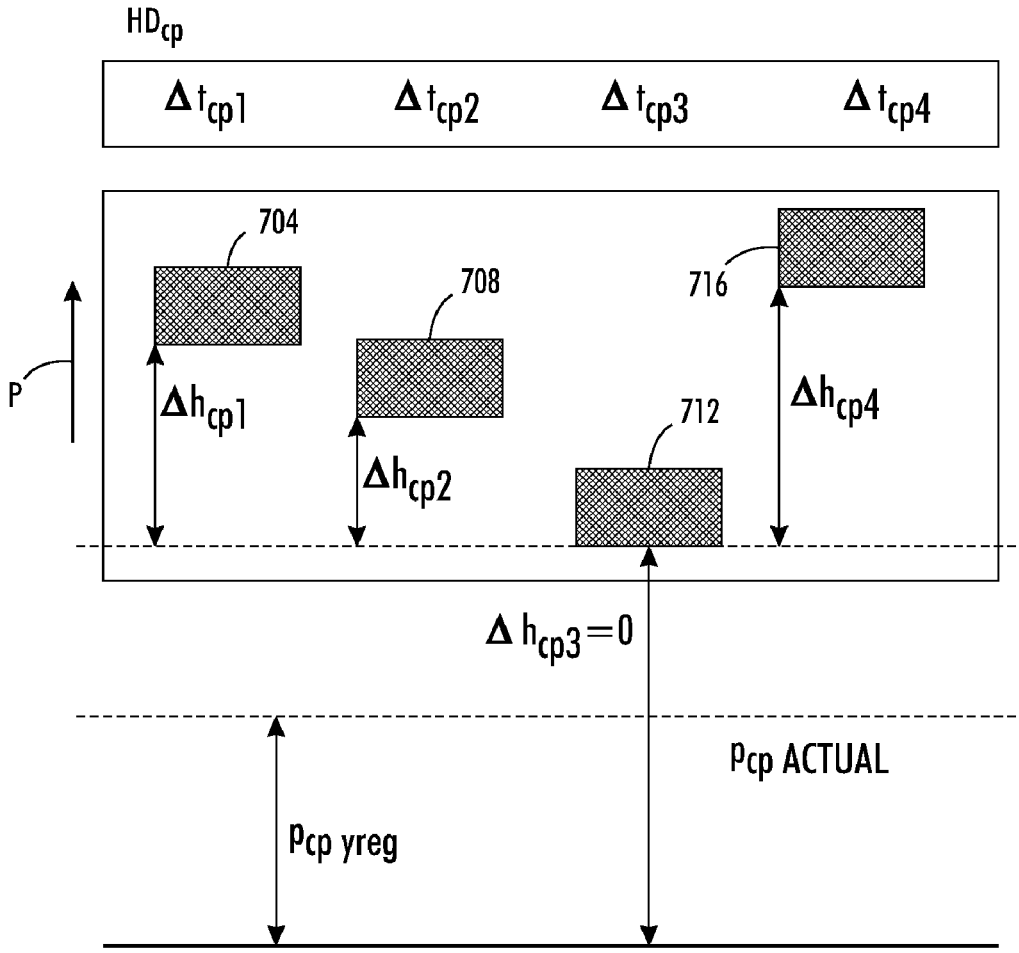
FIG. 7 is an illustration of printhead misalignment that causes registration errors in the process direction and the timing parameters that can be identified to correct for this misalignment.

After the printhead positions in the process direction have been identified for each printhead on a print bar, the timing parameters that compensate for printhead misalignment may be identified. An explanation of these parameters is made with reference to FIG. 7. As shown in that figure, media passes in process direction P past four printheads 704, 708, 712, and 716 that may be identified by an index cp1, cp2, cp3, and cp4, where c refers to an identifier for a color unit, p refers to an identifier for a print bar and the numbers 1, 2, 3, and 4 refer to the printhead position on the print bar in the cross-process direction. Thus, for the printheads shown in FIG. 7, the color unit and print bar identifier are the same. The $\Delta h_{cp1}$, $\Delta h_{cp2}$, $\Delta h_{cp3}$, and $\Delta h_{cp4}$ refer to the distance in the process direction between each printhead on the print bar and a selected reference printhead 712, respectively. $P_{cp}$ and $P_{cp\ yreg}$ refer to the actual print bar position determined from the image data and the expected position of the print bar in the process direction for proper registration, respectively. The printhead timing parameters $t_{cp1}$, $t_{cp2}$, $t_{cp3}$, and $t_{cp4}$ represent the amount of time required for adjusting delivery of the firing signal to the respective printhead cp1, cp2, cp3, and cp4 to operate the actuators in the printhead so the drops ejected by the printhead align with the drops printed by the reference printhead in the process direction. These printhead timing parameters compensate for the $\Delta h_{cp1}$, $\Delta h_{cp2}$, $\Delta h_{cp3}$, and $\Delta h_{cp4}$ alignment errors. Consequently, the total error $E_{cp}$ in the process direction for ejecting ink from the printheads on the print bar may be expressed as:

$$E_{cp}=HRP_{cp}+(P_{cp}-P_{cp\ yreg})-HD_{cp}*(\text{web speed})$$

where $HRP_{cp}$ is the effect of the misalignment of the printheads on the registration in the process direction, $(P_{cp}-P_{cp\ yreg})$ is the error distance in the process direction between where the print bar is located and the expected position of the print bar, and $HD_{cp}$*web speed is the effect of the timing parameters on the printheads to compensate for the misalignment affecting the registration in the process direction.

Again with reference to FIG. 3, once the printhead and print bar positions are identified and the reference printhead selected (block 358), the printhead timing parameters $t_{cp1}$, $t_{cp2}$, $t_{cp3}$, and $t_{cp4}$ are identified (block 362). Using the actual and expected position of the print bar, the process determines the print bar timing parameter (block 366). Once the positions for all of the print bars and their associated printheads are identified and the printhead and print bar timing parameters calculated (block 370), the firing signals for operating the printheads may be controlled to compensate for the misalignment of the printheads. In one embodiment, the printhead timing parameters are sent to the printhead driver circuit for each print bar where the printhead timing parameters are stored. The print zone controller, thereafter, generates firing signals with reference to the print bar timing parameter to enable the firing signal to be delivered to a printhead driver circuit to compensate for the error in the process direction positioning of the print bars (block 374). Once delivered to the printhead driver circuit for a print bar, the printhead driver circuit uses the printhead timing parameters to deliver the firing signal to the printheads operatively connected to the driver circuit to compensate for the misalignment of the printheads on the print bar (block 378). Alternatively, the print zone controller may generate a firing signal for each printhead with reference to the printhead timing parameters and the print bar timing parameter. Since the printhead misalignment in the process direction is a much smaller distance than the distance between the print bars, the process direction misregistration is less sensitive to web velocity variation. Downloading the printhead timing parameters to the printhead driver circuit, however, requires the consumption of fewer computing resources at the print zone controller.

At printer system setup, a registration pattern 210 (FIG. 5) may be provided to the binary image processor 208 and used to operate the printhead driver circuits 216 along with the firing signals from print zone controller 228. The printed registration target is imaged by imaging device 234 and the image data is processed by the signal processor in the registration processor 232. The registration processor 232 identifies the displacement distance between the actual position and the expected position of each print bar in the process direction and provides that data to the print bar compensator 226. The registration processor also selects a reference printhead on each print bar and identifies the printhead timing parameters for coordinated delivery of the firing signals to the printheads by the printhead driver circuits 216. The print bar compensator 226 identifies the print bar timing parameter for each print bar and provides that information to the print zone controller 228. Print zone controller 228 uses the print bar timing parameter to control the generation and delivery of a firing signal to a printhead driver circuit for a print bar. After the printhead timing parameters and print bar timing parameters have been identified, the registration target may be printed again and the process repeated to determine whether the registration of ink drops in the process direction is within a predetermined tolerance. The process may be repeated until the registration in the process direction is within the predetermined tolerance.

Once the printhead timing parameters and print bar timing parameters have been identified, operation of the printing system may commence. From time to time, a registration target may be printed and the image data for the registration target processed to determine whether registration in the process direction remains within the predetermined tolerance. The target registration may be printed in inter-document zones on the media to interleave the registration verification with a print job. If one or more printheads or printbars have moved, the process described above may be used to identify printhead timing parameter adjustments and print bar timing parameter adjustments. These adjustments are timing parameter changes that need to be made to the printhead timing parameters and the print bar timing parameters to return process direction registration to being within the predetermined tolerance. In one embodiment, rather than changing the printhead timing parameters by the entire amount of the printhead timing parameter adjustment in a single update, the printhead timing parameter adjustment is downloaded to the appropriate printhead driver circuit. The printhead driver circuit then updates the printhead timing parameter by predetermined time amounts between firing signals. That is, a predetermined amount of time is added to or subtracted from the printhead timing parameter currently being used and the new printhead timing parameter is used to deliver the next firing signal to the printhead. After a predetermined time has expired, another unit of predetermined time is used to adjust the printhead timing parameter and the adjusted printhead timing parameter is used to deliver the next firing signal. This updating of the printhead timing parameter continues until the full amount of the printhead timing parameter adjustment has been used to adjust the printhead timing parameter. In this manner, the process direction registration is changed gradually so the correction is introduced in stages. In one embodiment, the predetermined time between adjustments of the printhead timing parameter is the time for one scanline to be imaged by the optical imaging device.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method that compensates for process direction misalignment of printheads in a printer comprising:

identifying a position in the process direction for each printhead in a plurality of printheads mounted on at least one print bar in a printer;

identifying a position for the at least one print bar;

selecting one of the identified printhead positions as a reference printhead position for the printheads mounted to the at least one print bar;

identifying a printhead timing parameter for each printhead mounted to the at least one print bar, the printhead timing parameter being identified with reference to the reference printhead;

identifying a print bar timing parameter for the at least one print bar, the print bar timing parameter being identified with reference to the identified at least one print bar position;

generating a firing signal for the printheads mounted to the at least one print bar;

adjusting delivery of the firing signal to a printhead driver circuit associated with the at least one print bar by the identified print bar timing parameter to coordinate actuation of inkjet ejectors in the printheads mounted to the at least one print bar and compensate for location errors for the at least one print bar in the process direction; and adjusting delivery of the firing signal by the identified printhead timing parameter for each corresponding printhead to coordinate actuation of inkjet ejectors in the printheads mounted to the at least one print bar and compensate for misalignment of the printheads in the process direction.

2. The method of claim 1, the printhead timing parameter identification further comprising:

identifying the printhead timing parameter with reference to a linear speed for a web moving through the printer.

3. The method of claim 1 further comprising:

storing the identified printhead timing parameters for the printheads mounted to the at least one print bar in a memory of the printhead driver circuit, the printhead driver circuit being operatively connected to each printhead mounted to the at least one print bar and being configured to generate the firing signal for each printhead mounted to the at least one print bar.

4. A method that compensates for process direction misalignment of printheads in a printer comprising:

identifying a position in the process direction for each printhead in a plurality of printheads mounted on at least one print bar in a printer;

selecting one of the identified printhead positions as a reference printhead position for the printheads mounted to the at least one print bar;

identifying a printhead timing parameter for each printhead mounted to the at least one print bar, the printhead timing parameter being identified with reference to the reference printhead;

generating a firing signal for the printheads mounted to the at least one print bar;

adjusting delivery of the firing signal by the identified printhead timing parameter for each corresponding printhead to coordinate actuation of inkjet ejectors in the printheads mounted to the at least one print bar and compensate for misalignment of the printheads in the process direction;

detecting a change in printhead position in the process direction for at least one printhead mounted to the at least one print bar;

identifying a printhead timing parameter adjustment that corresponds to the detected change in the printhead position of the at least one printhead;

modifying the identified printhead timing parameter by a predetermined amount;

reducing the identified printhead timing parameter adjustment by the predetermined amount;

comparing the identified printhead timing parameter adjustment to a threshold; and continuing to modify the identified printhead timing parameter and to reduce the identified printhead timing parameter adjustment until the identified printhead timing parameter adjustment is equal to or less than the threshold.

5. The method of claim 4 further comprising:

delaying a predetermined amount of time before modifying the identified printhead timing parameter.

6. The method of claim 5 wherein the predetermined amount of time corresponds to an amount of time required for a distance of one scanline to pass by the at least one printhead at a measured linear web speed.

7. A printer comprising:

a media transport that is configured to transport media through the printer in a process direction;

a plurality of print bars, each print bar having a plurality of printheads mounted to a print bar and a printhead driver circuit that is operatively connected to each printhead mounted to a print bar to deliver a timing signal to each printhead mounted to the print bar to eject ink onto media being transported past the plurality of printheads on the print bar by the media transport in the process direction;

an imaging device mounted proximate to a portion of the media transport to generate image data corresponding to a cross-process portion of the media being transported through the printer in the process direction after the media has received ink ejected from the printheads mounted to the print bars; and a controller operatively connected to the imaging device and to the printhead driver circuits for the plurality of print bars, the controller being configured to identify a position for the at least one print bar and a print bar timing parameter corresponding to the identified position for the at least one print bar, to identify a position in the process direction for each printhead in the plurality of printheads mounted on the print bars and a printhead timing parameter corresponding to the identified position for each printhead mounted to the print bars, to send the identified printhead timing parameter for each printhead mounted to the print bars to the printhead driver circuit for each print bar, to generate a firing signal for at least one printhead driver circuit for at least one print bar, to adjust delivery of the firing signal to the printhead driver circuit for at least one print bar by the print bar timing parameter for the at least one print bar to coordinate actuation of inkjet ejectors in the printheads mounted to the at least one print bar and compensate for location errors for the at least one print bar in the process direction, each printhead driver circuit receiving the firing signal being configured to adjust delivery of the firing signal by the identified printhead timing parameter received from the controller for each corresponding printhead to coordinate actuation of inkjet ejectors in the printheads mounted to the at least one print bar and compensate for misalignment of the printheads in the process direction.

8. The method of claim 7, the controller being configured to identify the printhead timing parameter for each printhead with reference to a linear speed for a web moving through the printer.

9. A printer comprising:

a media transport that is configured to transport media through the printer in a process direction;

a plurality of print bars, each print bar having a plurality of printheads mounted to a print bar and a printhead driver circuit that is operatively connected to each printhead mounted to a print bar to deliver a timing signal to each printhead mounted to the print bar to eject ink onto media being transported past the plurality of printheads on the print bar by the media transport in the process direction;

an imaging device mounted proximate to a portion of the media transport to generate image data corresponding to a cross-process portion of the media being transported through the printer in the process direction after the media has received ink ejected from the printheads mounted to the print bars; and a controller operatively connected to the imaging device and to the printhead driver circuits for the plurality of print bars, the controller being configured to identify a position in the process direction for each printhead in the plurality of printheads mounted on the print bars and a printhead timing parameter corresponding to the identified position for each printhead mounted to the print bars, to send the identified printhead timing parameter for each printhead mounted to the print bars to the printhead driver circuit for each print bar, to generate a firing signal for at least one printhead driver circuit for at least one print bar, and to identify a printhead timing parameter adjustment that corresponds to a detected change in the identified position for at least one printhead mounted to the at least one print bar and send the identified printhead timing parameter adjustment to the printhead driver circuit for the at least one print bar, each printhead driver circuit receiving the firing signal being configured to adjust delivery of the firing signal by the identified printhead timing parameter received from the controller for each corresponding printhead to coordinate actuation of inkjet ejectors in the printheads mounted to the at least one print bar and compensate for misalignment of the printheads in the process direction, to modify the identified printhead timing parameter for the at least one printhead on the at least one print bar with reference to the identified printhead timing parameter adjustment, and to modify the identified printhead timing parameter by a predetermined amount between sending of the firing signal to the at least one printhead on the at least one print bar until the identified printhead timing parameter for the at least one printhead on the at least one print bar equals the identified printhead timing parameter adjustment.

10. The printer of claim 9, the printhead driver circuit being further configured to delay a predetermined amount of time before each modification of the identified printhead timing parameter by the predetermined amount.

11. The printer of claim 10 wherein the predetermined amount of time corresponds to an amount of time required for a distance of one scanline to pass by the at least one printhead at a measured linear web speed.

12. A method that compensates for process direction misalignment of printheads in a printer comprising:

identifying a position for the first print bar;

identifying a position in the process direction for each printhead in a plurality of printheads mounted on a first print bar;

selecting one of the identified printhead positions as a reference printhead position for the printheads mounted to the first print bar;

identifying a print bar timing parameter for the first print bar, the first print bar timing parameter being identified with reference to the identified first print bar position;

identifying a printhead timing parameter for each printhead mounted to the first print bar, the printhead timing parameter being identified with reference to the reference printhead;

generating a firing signal for the printheads mounted to the first print bar;

adjusting delivery of the firing signal to a printhead driver circuit associated with the first print bar by the identified print bar timing parameter to coordinate actuation of inkjet ejectors in the printheads mounted to the first print bar and compensate for location errors for the first print bar in the process direction; and adjusting delivery of the firing signal by the identified printhead timing parameter for each corresponding printhead to coordinate actuation of inkjet ejectors in the printheads mounted to the first print bar and compensate for misalignment of the printheads in the process direction.

13. A method that compensates for process direction misalignment of printheads in a printer comprising:

identifying a position in the process direction for each printhead in a plurality of printheads mounted on a first print bar;

selecting one of the identified printhead positions as a reference printhead position for the printheads mounted to the first print bar;

identifying a printhead timing parameter for each printhead mounted to the first print bar, the printhead timing parameter being identified with reference to the reference printhead;

generating a firing signal for the printheads mounted to the first print bar;

adjusting delivery of the firing signal by the identified printhead timing parameter for each corresponding printhead to coordinate actuation of inkjet ejectors in the printheads mounted to the first print bar and compensate for misalignment of the printheads in the process direction;

identifying a position in the process direction for each printhead in a plurality of printheads mounted on a second print bar;

selecting one of the identified printhead positions on the second print bar as a reference printhead position for the printheads mounted to the second print bar;

identifying a printhead timing parameter for each printhead mounted to the second print bar, the printhead timing parameter being identified with reference to the reference printhead on the second print bar;

delivering to the second print bar the firing signal for the printheads mounted to the first print bar; and adjusting delivery of the firing signal by the identified printhead timing parameter for each corresponding printhead to coordinate actuation of inkjet ejectors in the printheads mounted to the second print bar and compensate for misalignment of the printheads in the process direction.

14. The method of claim 13 further comprising:

identifying a position for the second print bar;

identifying a print bar timing parameter for the second print bar, the second print bar timing parameter being identified with reference to the identified second print bar position; and adjusting delivery of the firing signal to a printhead driver circuit associated with the second print bar by the identified print bar timing parameter to coordinate actuation of inkjet ejectors in the printheads mounted to the second print bar with the actuation of inkjet ejectors in the printheads mounted to the first print bar and compensate for location errors for the first and the second print bars in the process direction.

15. The method of claim 14 further comprising:

detecting a change in printhead position in the process direction for at least one printhead mounted to one of the first and the second print bars;

identifying a printhead timing parameter adjustment that corresponds to the detected change in the printhead position of the at least one printhead; and modifying the identified printhead timing parameter for the at least one printhead with reference to the identified printhead timing parameter adjustment for the printhead for which the position change was detected.

* * * * *